United States Patent [19]

Straubel et al.

[11] Patent Number: 4,476,829

[45] Date of Patent: Oct. 16, 1984

[54] ELECTRONIC CONTROL SYSTEM FOR THE FUEL QUANTITY OF AN INTERNAL COMBUSTION ENGINE HAVING SELF-IGNITION

[75] Inventors: Max Straubel, Stuttgart; Wolf Wessel, Oberriexingen, both of Fed. Rep. of Germany

[73] Assignee: Robert Bosch GmbH, Stuttgart, Fed. Rep. of Germany

[21] Appl. No.: 586,643

[22] Filed: Mar. 7, 1984

Related U.S. Application Data

[63] Continuation of Ser. No. 415,216, Sep. 7, 1982, abandoned.

[30] Foreign Application Priority Data

Dec. 11, 1981 [DE] Fed. Rep. of Germany ..... 3149095

[51] Int. Cl.[3] ..... F02D 31/00

[52] U.S. Cl. ..... 123/357

[58] Field of Search ..... 123/357, 358, 359, 478, 123/488, 489, 492

[56] References Cited

U.S. PATENT DOCUMENTS

| | | | |
|---|---|---|---|
| 3,548,795 | 12/1970 | Howland | 123/357 |
| 3,731,664 | 5/1973 | Tsuzuki et al. | 123/357 |
| 4,279,229 | 7/1981 | Arnold et al. | 123/357 |
| 4,357,920 | 11/1982 | Stumpp et al. | 123/358 |
| 4,372,266 | 2/1983 | Hiyama et al. | 123/357 |

*Primary Examiner*—Magdalen Y. C. Moy

*Attorney, Agent, or Firm*—Edwin E. Greigg

[57] ABSTRACT

An electronic control system for the fuel quantity of an internal combustion engine having self-ignition is proposed, in which above a predetermined load threshold the increase in fuel quantity is limited and a regulation of exhaust gas temperature is performed. The load threshold is preferably approximately 75% of the full-load value, and it may be dependent on operating characteristics, for instance on the rpm. Depending upon the engine type, it may be useful to regulate not the absolute exhaust gas temperature but rather the difference between the exhaust gas temperature and the temperature of the aspirated air.

9 Claims, 2 Drawing Figures

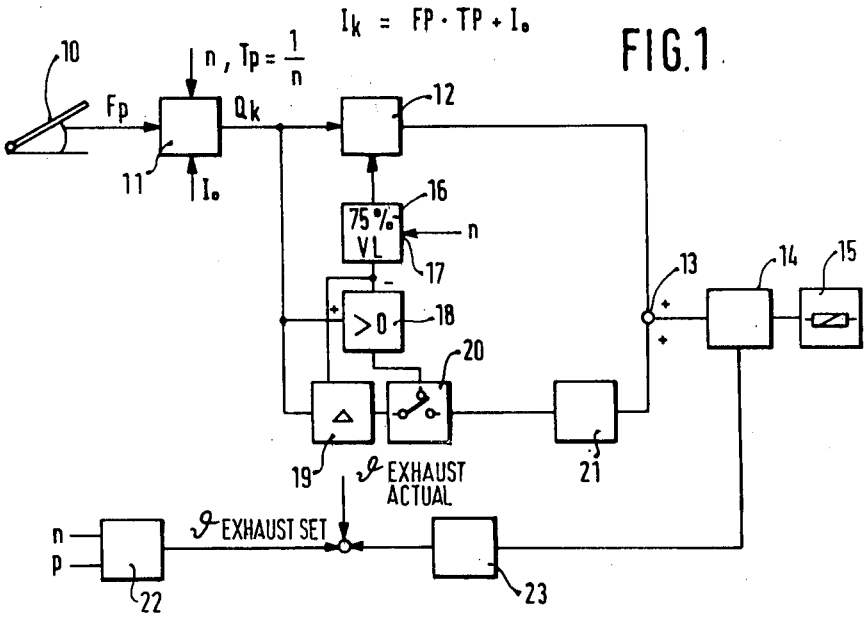
FIG. 2
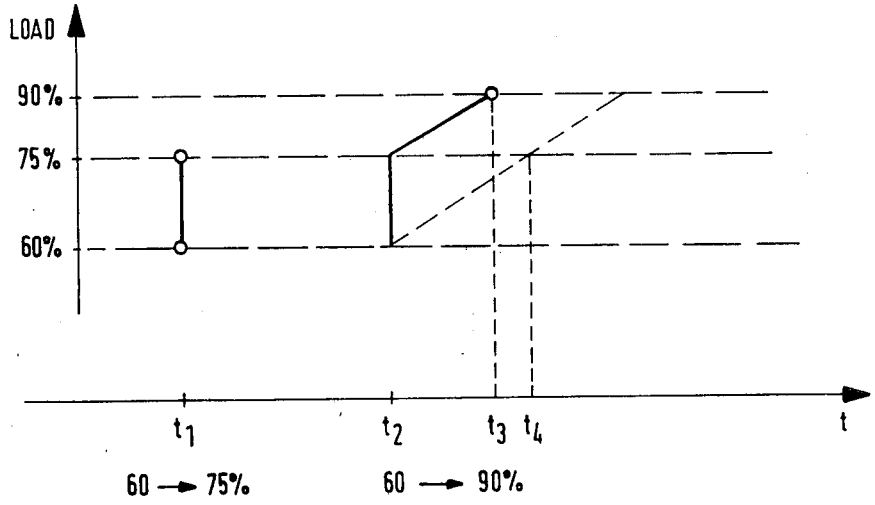

ELECTRONIC CONTROL SYSTEM FOR THE FUEL QUANTITY OF AN INTERNAL COMBUSTION ENGINE HAVING SELF-IGNITION

This is a continuation of copending application Ser. No. 415,216 filed Sept. 7, 1982 now abandoned.

BACKGROUND OF THE INVENTION

The invention is based on an electronic control system for the fuel quantity supplied to an internal combustion engine with self-ignition as generally defined hereinafter. From German Offenlegungsschrift No. 26 50 247, a method and an apparatus are known for limiting the maximum permissible fuel supply quantity of the fuel injection pump of a Diesel engine. In conventional Diesel injection systems, the driving pedal determines the position of a governor rod in the injection pump, and a stop assures that a given maximum injection quantity is not exceeded. The position of the stop adapts itself to the various operating conditions of the engine, above all to the rpm, load and exhaust gas temperature. To this end, a maximum value is read out of a performance graph in the known apparatus, in accordance with the rpm and the exhaust gas temperature; this maximum value is then compared with the maximum value for the charge pressure, for instance. Thus what is essential in the known system is the fact that the exhaust gas temperature is taken into consideration solely for forming a value for the position of the stop.

OBJECT AND SUMMARY OF THE INVENTION

In the control system according to the invention for the fuel quantity of an internal combustion engine having self-ignition the exhaust gas temperature is assigned a regulatory function because the exhaust gas temperature is a good criterion for the engine load or for the injection quantity, and the threshold values of a Diesel engine can be approximated to a better extent using this criterion.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 is a block circuit diagram for the control system according to the invention for the fuel quantity of an internal combustion engine having self-ignition; and FIG. 2 is a diagram intended to explain the mode of operation of the subject of FIG. 1.

DESCRIPTION OF THE PREFERRED EMBODIMENT

The exemplary embodiment relates to the electronic control system for the fuel quantity of an internal combustion engine having self-ignition. The output signal of a driving pedal 10 is supplied to a hyperbolic performance graph 11 for a fuel quantity intention. It is followed by a minimum-value selection circuit 12, a summing point 13, a second minimum-value selection circuit 14 and finally by the coil of an electromagnetic final control element 15 for the quantity-determining member of the injection pump. A threshold value control circuit 16 has entered into it, as an advantageous value, a value equivalent to 75% of the full-load value (VL).

This circuit 16 has a control input 17, for instance for an rpm signal. On the output side, the threshold value control circuit 16 is connected both with the minimum-value selection circuit 12 and with two difference-forming circuits 18 and 19 which can be realized by operational amplifiers. These two circuits additionally receive the fuel quantity intention signal QK from the performance graph 11 and are connected at the output side to a switch 20. This connection is such that if the output signal of the difference-forming circuit 18 is positive, the switch 20 allows the amount of the difference from the difference-forming circuit 19 to pass through to a time-delay circuit 21. The output signal of this circuit 21 in turn is sent to the second input of the summing point 13.

The second minimum-value selection circuit 14 receives as an additional input signal, the output value of an exhaust gas temperature regulating circuit 23, which processes the deviation between the actual value and the set-point value of the exhaust gas temperature. The set-point temperature of the exhaust gas is determined at a signal processing state 22 by the rpm (n) and additionally, under some circumstances, by the charge pressure, atmospheric pressure (p), etc.

The circuit layout shown in FIG. 1 functions as follows:

Depending upon the position of the driving pedal $F_p$ and the rpm (n), a particular fuel quantity intention QK is expressed; in the partial-load range this intention QK determines the trigger signal, via the minimal-value selection circuits 12 and 14, of the final control element for the quantity-determining member.

If the load exceeds the 75% mark given by way of example, then the second branch of the circuit including the difference-forming circuit 19, the switch 20 and the time-delay circuit 21 then additionally comes into play. The difference from the 75% mark in this case is passed along in a delayed manner, this delay being efficaciously realized by means of an integrator, and the amount of the difference thus becomes fully effective only after a predetermined period of time has elapsed. With a view to the regulation of the exhaust gas temperature which comes into effect in the upper load range, this is efficacious in order that the temperature regulation not be overridden by the greater dynamics of the rest of the system. This time delay is efficaciously adapted to the dynamics of the temperature regulator, the most important features of which are the sluggishness of the temperature sensor and the dead times of the system.

FIG. 2 is an approximate illustration of the behavior of the quantity signal over time, at two different load changes. In the first load change at time t1, the load is to be increased from 60 to 75%. For the sake of simplicity, this is presumed to be equivalent to a corresponding movement of the driving pedal. Since in this load change the threshold value is not yet exceeded, the fuel quantity intention QK is passed on directly, via the two minimum-value selection circuits 12 and 14, and the electromagnetic final control element 15 is triggered accordingly. The precondition here is that the final control element for the fuel quantity establishes an unequivocal relationship between the trigger signal and the position. In the simplest case, the final control element functions similarly to a moving-coil or moving-iron measuring instrument, so that the current for the final control element and the position are unequivocally related to one another. It can be seen that there is an immediately effective jump to 75%, effected by a direct signal course via the minimum-value selection circuit 12. Above this 75% threshold, the difference-forming circuit 18 emits a corresponding control signal to the switch 20, which allows the difference from the 75% value to pass through to the time-delay element 21. The output signal of this element 21, in turn, increases in accordance with a predetermined time function—in the illustrated example, this function is linear—up to the desired final value of 90%.

To the extent that the exhaust gas temperature regulator does not become effective, the control over time of the final control element 15 corresponds to the course of the signal shown in FIG. 2 between times t2 and t3. A jump in the fuel quantity is followed by an increase in fuel quantity which is less abrupt in terms of time. In other words, when the driving pedal is depressed as far as the full-load range, beginning at a partial-load range, the final control element current is made available; it corresponds to approximately 75% of full load in an aspirating and supercharged engine. Furthermore, a time-dependent release of fuel quantity is also made, delayed for a period of several seconds, up to the threshold defined by the exhaust gas temperature. Because of this delay, there are no overswings in the exhaust gas temperature; instead, the opportunity presents itself for stabilizing the temperature value to the maximum permissible value.

Under some circumstances it is recommended to process not the absolute exhaust gas temperature but instead the temperature difference between the exhaust gas and the aspirated air.

It may furthermore be efficacious as well for the further quantity increase following the jump to 75%, for example, to be initiated only after a certain period of time. This can be realized by skipping over the difference-forming circuit 19, so that the total quantity intention is switched through to the time-delay member 21, and the time-dependent increase is then based on the original value. In that case, the summing member 13 is replaced by an OR gate, and the signal jump at time t2 is followed by a phase of constant level, until time t4 when the time-dependent increase begins.

Depending upon the engine type being used, it has also proved useful to have a threshold dependent on operating characteristics, which can be realized via a control input 17, for instance for an rpm signal, in the threshold value control circuit 16.

As a rule, the exhaust gas temperature is also dependent on the onset of injection of the fuel injection nozzle and thus on the beginning of ignition of the fuel. This can be taken into consideration either by making an intervention into the threshold value control circuit 16 or via the set-point temperature for the exhaust gas.

In the described exemplary embodiment, the fuel quantity is adjusted via an electromagnetic final control element. Naturally the quantity can equally well be controlled via an electromagnetic valve.

It is also recommended that a maximum-rpm limitation be made by setting the quantity metering to zero.

It has been found that with the electronic control system according to the invention for the fuel quantity to be injected in an internal combustion engine having self-ignition, it is possible to compensate both for such thermodynamic positive-feedback effects as may occur, for instance, with supercharged engines and for misleading mechanical influences which occur with mechanical engine reaction signal. This compensation can be accomplished because the energy produced in internal combustion engines by the processes of combustion are converted into kinetic and thermal energy, and the kinetic component thereof can be perceived directly and acted upon by the operator of the vehicle, while the engine can be operated in optimal fashion via a regulation of the thermal component.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An electronic control system for regulating the fuel quantity in an internal combustion engine having self-ignition and a final control element in accordance with the driving pedal position, rpm and exhaust gas temperature, comprising means for determining the fuel quantity in dependence on the driving pedal position and the rpm, means for providing a predetermined load threshold, means for limiting the function of said fuel quantity above said load threshold, thereby delaying an increase in fuel quantity, and means for limiting the fuel quantity to said final control element in accordance with the exhaust gas temperature.

2. A control system as defined by claim 1, wherein said load threshold is dependent on operating characteristics.

3. A control system as defined by claim 1, wherein said load threshold is dependent on rpm.

4. A control system as defined by claim 1, wherein said load threshold is approximately 75% of the full load.

5. A control system as defined by claim 1, wherein the delay is within the range of seconds.

6. A control system as defined by claim 1, wherein said exhaust gas temperature comprises a set-point value dependent on at least one of the variables of rpm, charge pressure, injection onset and air throughout in an intake tube of said engine.

7. A control system as defined by claim 5, further comprising means for processing the value of the difference of said exhaust gas temperature from the aspirated air temperature.

8. A control system as defined by claim 5, wherein the fuel metering is switched off after the attainment of the maximum rpm.

9. A method for an electronic control system for regulating the fuel quantity in an internal combustion engine having self-ignition and a final control element in accordance with the driving pedal position, rpm and exhaust gas temperature, comprising the steps of determining the fuel quantity in dependence on the driving pedal position and on the rpm, providing a predetermined load threshold, limiting the function of said fuel quantity above said load threshold, thereby delaying an increase in fuel quantity, and limiting the fuel quantity to said final control element in accordance with the exhaust gas temperature.

* * * * *